US005179794A

United States Patent [19]

Ballinger

[11] Patent Number: 5,179,794

[45] Date of Patent: Jan. 19, 1993

[54] SEMI-AUTOMATIC COUPLING APPARATUS

[76] Inventor: Jon C. Ballinger, 412 Scarlet Oak Dr., Findley, Ohio 45840

[21] Appl. No.: 813,446

[22] Filed: Dec. 26, 1991

[51] Int. Cl.[5] ..... E02F 3/28; E02F 3/96

[52] U.S. Cl. ..... 37/117.5; 37/103; 172/272; 403/322; 403/325; 403/330; 414/686; 414/723

[58] Field of Search ..... 414/686, 723, 912; 172/272; 37/117.5, 103; 403/322, 325, 330

[56] References Cited

U.S. PATENT DOCUMENTS

| | | | |
|---|---|---|---|
| 4,187,050 | 2/1980 | Barbee | 414/723 |
| 4,214,840 | 7/1980 | Beales | 414/723 X |
| 4,632,595 | 12/1986 | Schaeff | 414/723 X |
| 4,810,162 | 3/1989 | Fosler | 414/723 |
| 4,986,722 | 1/1991 | Kaczmarczyk et al. | 414/723 |
| 5,082,389 | 1/1992 | Balemi | 414/723 X |

*Primary Examiner*—Randolph A. Reese

*Assistant Examiner*—Arlen L. Olsen

*Attorney, Agent, or Firm*—Willian Brinks Olds Hofer Gilson & Lione

[57] ABSTRACT

A semi-automatic coupling apparatus is installed at the terminus of a backhoe dipper stick, crane boom or similar device and facilitates connection and disconnection of various earth working and material handling attachments. The coupler includes first, forward facing throats which engage a forward crossbar on an attachment such as a bucket and second, downward facing throats which engage a rear crossbar. A latching mechanism includes a pawl actuated by advance of the rear crossbar into the rear throats. The pawl releases a spring biased wedge member which retains the rear crossbar in the rear throat. A reset linkage may be manually activated to retract the wedge and permit release of the bucket from the coupler. An alternate embodiment of the coupler includes a remotely activated hydraulic or pneumatic cylinder which is coupled to the spring biased wedge member.

20 Claims, 3 Drawing Sheets

SEMI-AUTOMATIC COUPLING APPARATUS

BACKGROUND OF THE INVENTION

The invention relates generally to couplers for selectively interconnecting cranes and backhoes to various earth and material handling devices such as buckets, blades and claws and more specifically to a coupler which may be permanently attached to the crane boom or backhoe dipper stick which automatically attaches to and manually releases from a bucket, blade, claw or material handling attachment.

The broad utility of cranes and backhoes is apparent from the even broader array of attachments with which such devices are utilized. For example, buckets, grapples, blades, picks and hooks are all commonly used with cranes and backhoes. Furthermore, within the broad category of buckets are numerous styles and sizes intended for digging variously shaped trenches in diverse material or relocating materials, for example, from or to the ground or a dump truck.

With this versatility comes the attendant problem of interchanging such attachments on a given crane or backhoe. Given the specialization of attachments one particular attachment may only be utilized for a brief task and changing attachments becomes an ever present and time consuming problem.

The problem has not gone unaddressed. There exists a relatively extensive collection of devices having the purpose of permitting expeditious connection, use and release of one attachment and re-connection of another. Generally speaking, these devices can be segregated into two classes: those which require manual activation to connect and/or release an attachment and those which incorporate remotely controlled mechanisms which render the coupling and disconnection substantially automatic. Manually activated devices will be reviewed first.

U.S. Pat. No. 4,187,050 to Barbee teaches a quick disconnect coupling mechanism which includes a forward, curved member which opens to the rear and engages a forward crossbar on a bucket and a rear hook-like member which receives a rear bucket crossbar. The rear member pivots to a crossbar retaining position and is maintained there by a spring biased latch. U.S. Pat. No. 4,214,840 to Beales teaches a quick-release coupler having a pair of parallel crossbars which are received within correspondingly positioned, diversely oriented throats on a bucket which also includes a spring biased latch mechanism. A hydraulically operated latch mechanism is also disclosed.

In U.S. Pat. No. 4,297,074 to Ballinger, the bucket likewise includes a pair of parallel spaced-apart crossbars which are engaged by a coupling member having front throats and rear throats which are oriented at 90° to one another. A pivotable locking clevis disposed on the rear bucket crossbar secures the coupler to the bucket. In U.S. Pat. No. 4,436,477 to Lenertz et al.. a coupler includes similarly oriented front and rear throats as well as a pivoting hook which translates to engage and retain a rear bucket crossbar in the rear throat of the coupler.

U.S. Pat. No. 4,632,595 to Schaeff utilizes a bucket having a forward crossbar member and rear plate. The coupler includes forward opening throats which engage the front crossbar member and a spring biased latch at the rear which hooks on the underside of the plate.

Attachment is automatic and release requires manual translation of the hook to overcome a biasing spring.

U.S. Pat. No. 4,810,162 to Foster teaches another variation on a coupler having an open forward throat which engages a forward crossbar in a bucket and a moving member at the rear which pivots and engages a rear crossbar. The frame of the coupler includes slots for receiving the rear crossbar and a pivoting member spaced between the walls of the coupler which engages the bucket crossbar and pivots to retain the crossbar in the rear coupler slots. In U.S. Pat. No. 4,854,813 to Degeeter et al., the bucket includes forward and rearward circular reentrant regions which receive complementarily configured and disposed transverse members on the boom. A sliding latch is manually positioned to retain the bucket boom components in the re-entrant regions of the bucket.

U.S. Pat. No. 4,955,779 presents another connector wherein the bucket includes opposed re-entrant channels and the coupler includes complementarily disposed members which engage the reentrant portions and secure the bucket to the boom. In U.S. Pat. No. 4,986,722 to Kaczmarczyk et al., a combination of the above features are found. At the front of the bucket, a circular cross member is utilized which is engaged by a transverse slot on the boom coupler. At the rear of the bucket are a pair of spaced apart slotted members which receive a transverse circular member disposed on the boom. A manually operable latch retains the rear transverse boom member in the slots of the bucket.

The second group of prior art patents includes remotely activatable coupling devices. U.S. Pat. No. 4,355,945 to Pilch teaches a coupling mechanism similar to that disclosed in U.S. Pat. No. 4,436,477. The bucket includes a pair of transversely disposed spaced-apart crossbars and the coupler includes sidewalls slotted at the front to engage the front crossbar and a hydraulically operated pivotable hook which engages the rear crossbar and clamps the coupler thereto.

In U.S. Pat. No. 4,480,955, the bucket includes unique coupling features, namely, a forward triangularly configured crossbar and a rearward hook. The coupler includes complementary members, namely, a transversely disposed triangular notch at the front and a hydraulically operated wedge which engages the hook. U.S. Pat. No. 4,881,867 presents a coupler configured to engage parallel transversely oriented bucket crossbars. The coupler includes a first throat for engaging the forward crossbar and a hydraulically operated movable jaw extending from the coupler housing which engages the rear bucket crossbar. U.S. Pat. No. 4,944,628 teaches a novel locking mechanism wherein a hydraulic cylinder rotates a cam to couple and uncouple a bucket and boom.

The foregoing review of prior art patents reveals that improvements in the art of such coupling mechanisms are both possible and desirable. For example, many utilize non-standard interconnecting components which may only be used with complementarily configured devices, thereby limiting their versatility and adaptability. Others require the crane or backhoe operator to dismount to connect and disconnect the attachment. This can be a time consuming and frustrating task since the operator may have to adjust the crane or boom, dismount to connect the attachment or, if the boom is not properly positioned relative to the attachment, repeatedly remount and readjust the boom before it can be connected to the attachment.

SUMMARY OF THE INVENTION

A semi-automatic coupling apparatus is permanently installed at the terminus of a backhoe dipper stick, crane boom or similar device and facilitates connection and disconnection of various earth working and material handling attachments. The coupling apparatus includes pairs of aligned, spaced-apart bushings which receive complementarily sized crossbars which extend through similarly arranged bushings in the terminal portion of the crane boom or dipper stick and secure the coupler to the boom or dipper stick. The coupler includes first, forward facing throats which engage a forward crossbar on an attachment such as a bucket and second downward facing throats which engage a rear crossbar. A latching mechanism includes a trip lever actuated by advance of the rear crossbar into the rear throats, releasing a wedge which retains the rear crossbar in the rear throats. A reset arm may be manually activated to retract the wedge and permit release of the bucket from the coupler.

The coupling apparatus facilitates addition or retrofitting to a boom or dipper stick and engagement with a bucket or other device previously coupled directly to the boom or dipper stick. An alternate embodiment of the coupler includes a remotely activated hydraulic or pneumatic cylinder which is coupled to the wedge and may be remotely controlled to couple or release a bucket or other attachment.

Thus it is an object of the present invention to provide a semi-automatic boom or dipper stick to attachment coupler.

It is a further object of the present invention to provide a boom or dipper stick to attachment coupler which facilitates ready, automatic coupling of an attachment but which must be manually activated to release the attachment.

It is a still further object of the present invention to provide a boom or dipper stick to attachment coupler having standardized coupling components facilitating retrofitting of the coupler to existing equipment in order to provide automatic coupling of attachments and manual release thereof.

Further objects and advantages of the present invention will become apparent by reference to the following specification and appended drawings.

DESCRIPTION OF THE PREFERRED EMBODIMENT

Figure 1:
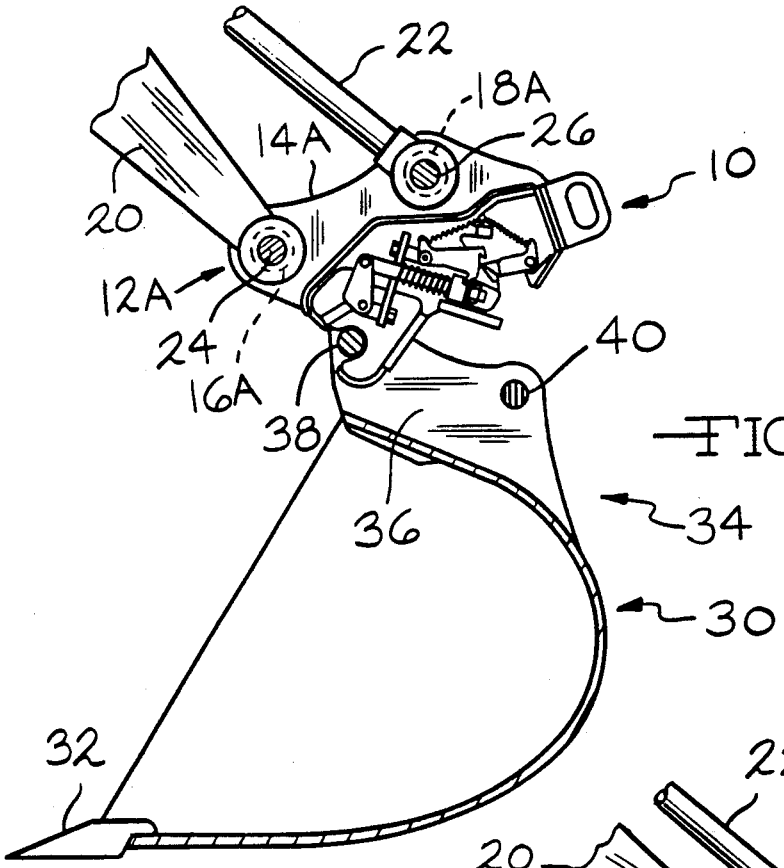
FIG. 1 is a full sectional view of a bucket and semi-automatic coupling apparatus according to the instant invention disposed upon a backhoe dipper stick with the coupling apparatus partially engaged to the bucket.
Figures 3, 4, 5:
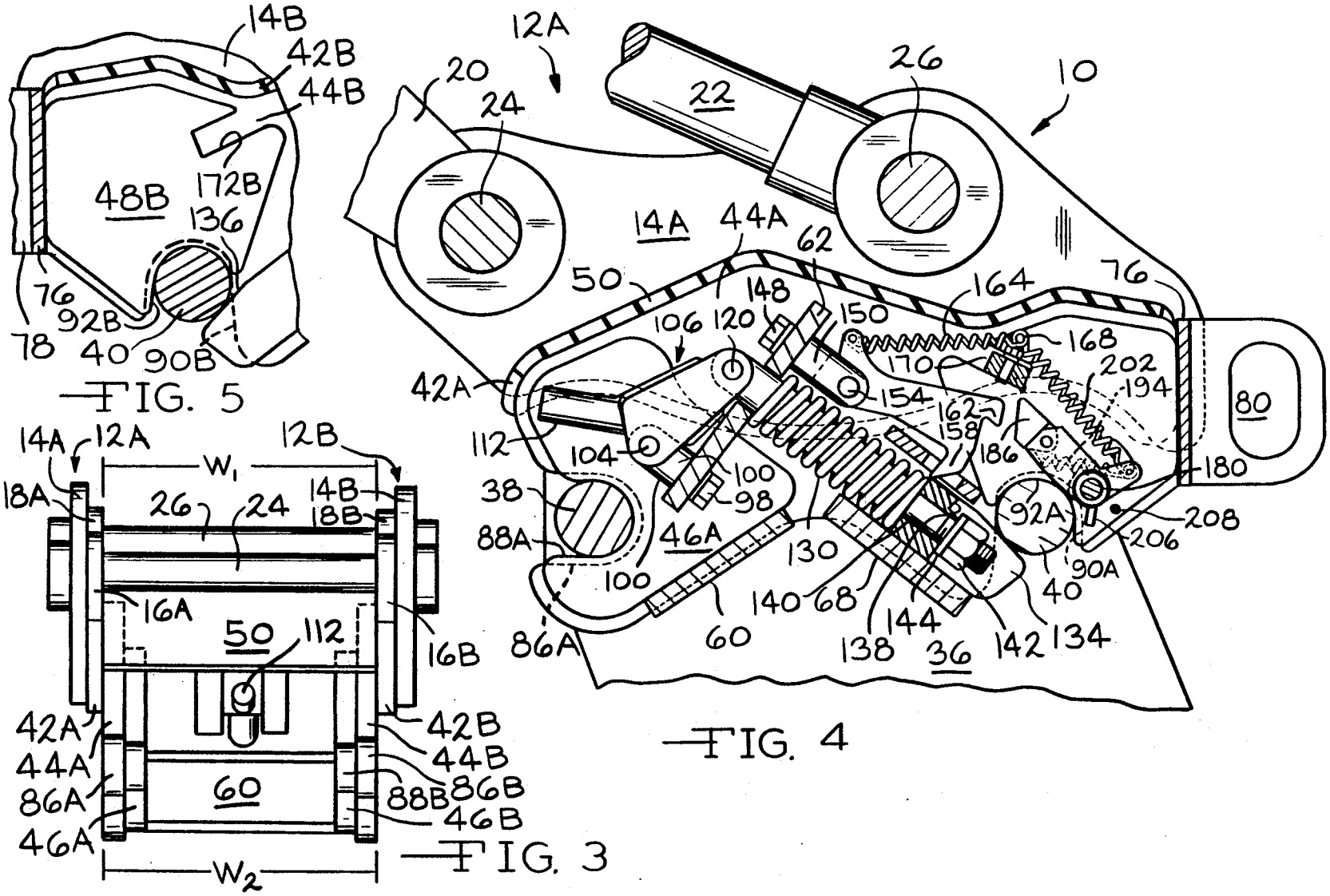
FIG. 3 is an end elevational view of a semi-automatic coupling apparatus according to the present invention.
FIG. 4 is a full sectional view of a semi-automatic coupling apparatus according to the present invention in the fully engaged position.
FIG. 5 is a fragmentary elevational view in partial section of the right rear, sidewall portion of a semi-automatic coupling apparatus according to the present invention.

Referring now to FIGS. 1 and 3, a semi-automatic coupling apparatus according to the present invention is illustrated and generally designated by the reference numeral 10. The coupling apparatus 10 includes a pair of spaced-apart, symmetrical left and right body sidewall assemblies 12A and 12B. The body sidewall assemblies 12A and 12B both define generally irregular curved peripheries and which may be chosen to satisfy both structural and esthetic considerations. The left sidewall assembly 12A includes an elongate left first, outer plate 14A and the right sidewall assembly 12B includes an elongate right first, outer plate 14B. Each of the first, outer plates 14A and 14B includes a respective one of a first pair of aligned bushings 16A and 16B disposed generally adjacent one end and a respective one of a second pair of aligned bushings 18A and 18B disposed proximate the middle.

The bushings 16A and 16B define a first axis and the bushings 18A and 18B define a second axis preferably spaced a standardized distance therefrom. The distance is chosen to correspond to the conventional design spacing between crossbars on a bucket or other attachment such that a backbone dipper stick or crane boom linkage such as the beams 20 and 22 engage the coupling apparatus 10 and translate it in the same way as a device attached directly thereto in response to positioning commands. The first pair of bushings 16A and 16B receive a front captive crossbar 24 which extends through a complementary transverse aperture in the terminal portion of the beam 20 and the second pair of bushings 18A and 18B receive a rear captive crossbar 26 which extends through a complementary transverse aperture in the terminal portion of the beam 22.

The coupling apparatus 10 may be utilized with not only a variety of cranes or backhoes (not illustrated) but also a wide variety of buckets and other earth moving equipment such as blades, picks and the like. In FIG. 1, there is illustrated a conventional bucket 30 having a plurality of teeth 32, one of which is illustrated in FIG. 1, disposed in a transversely aligned, spaced-apart array along the leading edge of the bucket 30. The bucket 30 also includes an attachment structure 34 generally adjacent the upper portion of the bucket 30. The attachment structure 34 includes a pair of parallel plates 36, one of which is illustrated in FIG. 1, which support and secure a transversely disposed front crossbar 38 and a spaced-apart parallel rear crossbar 40. The spacing between the axes of the front crossbar 38 and the rear crossbar 40 is preferably the same distance as the spacing between the axes of the bushings 16A and 16B and 18A and 18B such that the coupling apparatus 10 may be readily interposed between a boom or dipper stick and a bucket or other attachment.

It will thus be appreciated that the coupling apparatus 10 is an intermediate or adaptor-like device which is disposed between components of a backhoe dipper stick or crane boom and a bucket or other attachment where, previously, the boom or dipper stick was coupled directly to the bucket or other attachment. The width, i.e., the interior transverse axial distance between the faces of the bushings 16A and 16B and 18A and 18B, the distance marked $W_1$ in FIG. 3, is the same spacing between the parallel plates 36 of a conventional bucket 30 such that the terminal portions of the beams 20 and 22 of the dipper stick or boom may be received therebetween with little axial play.

The sidewall assemblies 12A and 12B further include a pair of symmetrically configured and disposed left and right second, middle plates 42A and 42B, respectively, which generally depend from and are secured to the outer plates 14A and 14B. To the opposed, interior surfaces of the plates 42A and 42B are secured respective left and right third, inner plates 44A and 44B. The third, inner plates 44A and 44B define features which receive the crossbars 38 and 40 of the bucket 30 or similarly spaced and configured mounting components of other attachments. Thus, the outside face-to-face width of the third, inner plates 44A and 44B, designated by the letter $W_2$ in FIG. 3, is the same as the interior bushing width $W_1$. A bucket 30 or other attachment having a width $W_2$ between the parallel plates 36 which was fabricated to receive the transverse terminal portions of the beams 20 and 22 of a dipper stick or boom will receive the coupling apparatus and specifically the mounting plates 44A and 44B without shims, spacers or other instrumentalities.

Referring now to FIGS. 3, 4 and 5, there is disposed and secured on the opposed surfaces of the third, inner plates 44A and 44B a first pair of identical, irregular interior plates 46A and 46B disposed adjacent the front of the coupling apparatus 10 and a second pair of identical, irregular interior plates 48A and 48B disposed adjacent the rear of the coupling apparatus 10. A protective cover 50 extends between the second, middle plates 42A and 42B. The cover 50 generally conforms to the profile of the upper edge of the third, inner plates 44A and 44B and protects the mechanism of the coupling apparatus 10 from dirt and debris.

The sidewall assemblies 12A and 12B including the plates 14A and 14B, 42A and 42B, 44A and 44B, 46A and 46B and 48A and 48B are preferably steel and are secured together by welding or other suitable high strength fastening means such as fasteners and the like. Alternatively, the stepped configuration of the sidewall assemblies 12A and 12B, including the panels 14A and 14B, 42A and 42B, 44A and 44B, 46A and 46B and 48A and 48B, may be achieved by machining from solid metal stock or the assemblies 12A and 12B may be fabricated by a combination of such components and processes.

The left and right sidewall assemblies 12A and 12B are spaced-apart and secured together by a plurality of metal plates or panels extending and secured therebetween by welding. A first transverse panel 60 extends between the third, inner plates 44A and 44B generally adjacent a lower linear edge of the interior plates 46A and 46B. A second transverse panel 62 likewise extends between and is secured by weldment to the third, inner plates 44A and 44B and interior plates 46A and 46B. The second transverse panel 62 defines a centrally disposed through opening 64 and a pair of smaller, vertically aligned openings 66A and 66B. A third transverse panel 68 also extends between and is secured to the inner plates 44A and 44B and is aligned with a lower edge thereof. Spaced from and parallel to the panel 68 is a fourth transverse panel 70 which is similarly disposed and secured between the third, inner plates 44A and 44B. The third transverse panel 68 and the fourth transverse panel 70 define a transversely elongate passageway 72 therebetween. A rectangular aperture 74 is formed in the fourth transverse panel 70. Finally, a fifth transverse panel 76 extends between the sidewall assemblies 12A and 12B adjacent the rear of the coupling assembly 10 in contact with the ends of the plates 42A and 42B, 44A and 44B and 48A and 48B. The fifth panel 76 is secured to the just recited plates by weldments. A plate 78 disposed parallel to and intermediate the sidewall assemblies 12A and 12B is coupled to the panel 76 by welds and defines an oval aperture 80 which may receive a chain, hook or other lifting device which may, in turn, be utilized to conveniently raise and transport objects which are not readily moveable within the bucket 30 or other attachment to the coupling apparatus 10.

With continuing reference to FIGS. 3, 4 and 5, it will be appreciated that the first pair of irregular plates 44A and 44B define a first pair of spaced-apart aligned throats 86A and 86B. The throats 86A and 86B define semi-circular re-entrant regions having tangentially extending sidewalls. The adjacent interior plates 46A and 46B define a second pair of smaller diameter throats 88A and 88B having a diameter just slightly larger than the diameter of the crossbar 38. The second pair of aligned throats 88A and 88B likewise define a semi-circular re-entrant region having generally similar though shorter tangentially extending sidewalls. The distinct diameters of the first pair of throats 86A and 86B and the second pair of throats 88A and 88B provide distinct functions. The slightly larger size of the first pair of throats 86A and 86B assist alignment of the front crossbar 38 of a bucket 30 with the coupling assembly 10 whereas the smaller size of the second pair of throats 88A and 88B relatively closely engages the crossbar 38 and thus minimizes unwanted movement or play between the coupling apparatus 10 and the bucket 30.

It will thus be appreciated that the first pair of throats 86A and 86B function with the front crossbar 38 as positioning and alignment members whereas the second pair of throats 88A and 88B function as the actual front crossbar 38 engagement members and load bearing structures.

At the opposite end of the coupling apparatus 10 the third inner panels 44A and 44B define a third pair of spaced-apart aligned throats 90A and 90B defining semi-circular re-entrant regions having tangentially extending sidewalls. The adjacent interior plates 48A and 48B define a fourth pair of spaced-apart throats 92A and 92B, respectively. The throats 92A and 92B define a semi-circular region and each includes a tangentially extending sidewall. The third pair of throats 92A and 92B have a larger diameter and act as an aligning and positioning components for the rear crossbar 40 whereas the fourth pair of throats 92A and 92B act as engagement and load bearing members having a diameter just slightly larger than the diameter of the rear crossbar 40 thereby engaging and receiving the crossbar 40 with little play or movement. The first and the second pair of throats 86A and 86B and 88A and 88B open, i.e., define lines of access, at an angle preferably 90° to the line of access of the third and the fourth pair of throats 90A and 90B and 92A and 92B.

It will be appreciated that the center axes of the first pair of throats 86A and 86B and 88A and 88B are coaxial. Likewise, the center axes of the third pair of throats 90A and 90B and the fourth pair of throats 92A and 92B are coaxial. The distance between the axis of the first and the second pair of throats 86A and 86B and 88A and 88B and the third and the fourth pair of throats 90A and 90B and 92A and 92B preferably defines the standardized center-to-center distance between the transversely disposed crossbars 38 and 40 of the bucket 30. It will also be appreciated that the reference to and description of pairs of throats relates to and results from the utilization of the pair of spaced-apart sidewall assemblies 12A and 12B which define and include the throats 86A and 86B, 88A and 88B, 90A and 90B and 92A and 92B. The coupling apparatus 10, however, could readily be constructed with a continuous, solid transverse member defining the front crossbar 38 engaging throats 88A and 88B and a substantially continuous transverse member defining the rear crossbar receiving throats 92A and 92B which would be referred to as the front throat and the rear throat. In other words, with regard to the term throats, it should be construed to include a single, continuous or substantially continuous throat or a pair of spaced-apart throats as such constructions are equivalent and contemplated by the inventor.

The lower aperture 66A of the interior panel 62 receives a bolt 98 which is threadably received within and secures a stanchion 100 on the opposite face of the second transverse panel 62. The stanchion 100 includes a radially extending through aperture 102 which receives a pivot pin 104 which in turn pivotally supports a clevis assembly 106. The clevis assembly 106 likewise includes a pair of opposed aligned openings 108 which receive the pivot pin 104. The pivot pin 104 functions as the fulcrum for the clevis assembly 106 which operates as a first class lever. A stub shaft 112 extends obliquely from the clevis assembly 106. An operator bar 114 (illustrated in FIG. 2) includes a complementarily sized, axially extending blind opening 116. The operator bar 114 may be engaged upon the stub shaft 112 to pivot the clevis assembly 106 about the fulcrum defined by a pivot pin 104.

The clevis assembly 106 also defines a second pair of spaced-apart aligned apertures 118 which receive a second pivot pin 120. The second pivot pin 120 passes through a complementarily sized radially disposed aperture 122 in an actuator rod 124. The actuator rod 124 includes a step and a reduced diameter region 126 having threads 128 adjacent its terminus. The actuator rod 124 extends through the aperture 64 in the second transverse panel 62 and receives a compression spring 130 thereabout. The compression spring 130 is axially constrained between a face of the transverse panel 62 and a wedge block 132. The wedge block 132 is generally U-shaped and includes a pair of spaced-apart arms 134 which each define a spaced-apart obliquely oriented cam surface 136. Disposed between the arms 134 is an obliquely disposed latch surface 138. The wedge block 132 is constrained to translate obliquely in the passageway 72 defined by the interior panels 68 and 70.

The wedge block 132 also defines a through aperture 140 which receives the reduced diameter region 126 of the actuator rod 124. A threaded fastener such as a nut 142 retains the wedge block 132 on the actuator rod 124 and maintains the compression spring 130 thereabout. Preferably, a lock washer 144 or other anti-rotation device such as a cotter pin extending through castellations in the nut 142 (both not illustrated) is utilized to inhibit rotation of the nut 142 on the threads 128. It will be appreciated that rotation of the nut 142 not only permits preload adjustment of the compression spring 130 but also permits adjustment of the position of the wedge block 132 and particularly the oblique surfaces 136 relative to the rear crossbar 40 received within the pair of throats 92A and 92B.

A threaded fastener 148 extends through the small, upper aperture 66B of the second transverse panel 62 and retains a clevis 150 on one face thereof. The clevis 150 includes a pair of aligned spaced-apart apertures 152 which receive and retain a pivot pin 154 which, in turn, pivotally mounts a latch member 156. The latch member 156 includes a through passageway 158 having a diameter slightly larger than the pivot pin 154 which receives the pivot pin 154. The latch member 156 also defines a primary hook or latch 160 and a secondary hook or latch 162. The primary latch 160 is disposed in alignment with the latch surface 138 of the wedge block 132 and extends through the aperture 74 in the panel 70. The primary latch 160 of the latch member 156 is capable of engaging the latch surface 138 and retaining the wedge block 132 in the position illustrated in FIG. 1 such that the rear crossbar 40 may be received within the throats 92A and 92B and may be moved upwardly to release the wedge block 132 to retain the rear crossbar 40 within the throats 92A and 92B.

A first tension spring 164 extends between an aperture 166 in the latch member 156 and an attachment structure 168 such as a hook or pin disposed upon a crossbar 170. The ends of the crossbar 170 are received and secured within complementarily configured notches 172A and 172B in the second pair of irregular interior plates 48A and 48B, respectively. The first tension spring 164 biases the latch member 156 and particularly the primary latch 160 toward the wedge block 132.

Disposed in operable relationship with the latch member 156 is a pawl assembly 174. The pawl assembly 174 defines a clevis like member having a through aperture 176 which receives a transverse pin 178. The transverse pin 178 extends between and is secured to the second pair of irregular interior plates 48A and 48B. A pair of spacers 180, one of which is disposed on each side of the pawl assembly 174, are received on the transverse pin 178 and maintain the pawl assembly 174 in alignment with the latch member 156. A pawl 186 is pivotally secured to the pawl assembly 174 by a pivot pin 188 extending between and retained within aligned, spaced-apart apertures 190 in the pawl assembly 174 and through an aperture 192 in the pawl 186 having a diameter slightly larger than the diameter of the pivot pin 188. A second tension spring 194 extends between the lower portion of the pawl 186 and a captive pin 196 received within and extending between an aligned, spaced-apart pair of apertures 198. The second tension spring 194 biases the pawl 186 in a counterclockwise direction as illustrated in FIGS. 4 and 5. The pawl 186 engages the secondary latch 162 on the latch member 156 and moves the latch member 156 in a counterclockwise direction as viewed in FIGS. 4 and 5 when the pawl assembly 174 is acted upon by the rear crossbar 40 entering the third and the fourth pair of throats 90A and 90B and 92A and 92B, respectively. A third tension spring 202 is disposed between the captive pin 196 and the attachment member 168. The third tension spring 202 biases the pawl assembly 174 in a counterclockwise direction as viewed in FIGS. 4 and 5, driving the pawl assembly 174 toward the third pair of throats 90A and 90B and the fourth pair of throats 92A and 92B.

The pawl assembly 174 also includes a depending tab or ear 206. A crossbar 208 extends between and is secured to the second pair of irregular interior plates 48A and 48B. The pawl assembly 174 is illustrated in FIG. 4 in the position it assumes when the coupler apparatus 10 is coupled to a bucket 30 or other attachment. When the rear crossbar 40 of the bucket 30 descends from the throats 92A and 92B, the pawl assembly 174 rotates counterclockwise under the influence of the tension spring 202 and gravity, through an angle of about 35° at which point the ear 206 contacts the crossbar 208. The pawl assembly 174 is then in the position illustrated in FIG 1.

Figures 6, 7:
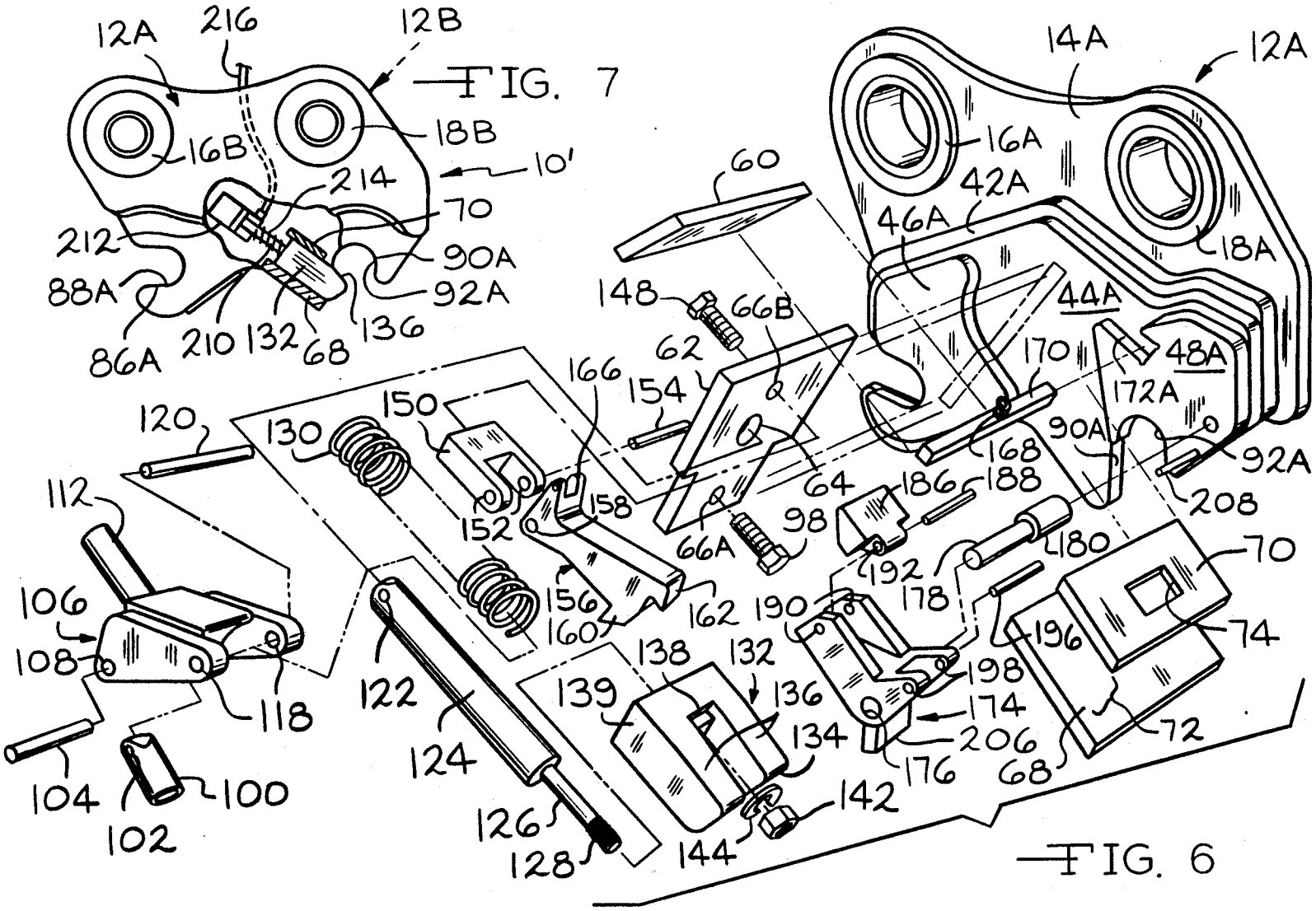
FIG. 6 is an exploded perspective view of a semi-automatic coupling apparatus according to the present invention.
FIG. 7 is a side elevational view with portions broken away of a first alternate embodiment of a coupling apparatus according to the present invention.

Referring now to FIG. 7, a first alternate embodiment of the coupler apparatus 10 is illustrated and designated by the reference numeral 10'. The alternate embodiment coupler apparatus 10' is similar to the preferred embodiment coupler apparatus 10 in most respects. Structurally, it includes the same left and right sidewall assemblies 12A and 12B, respectively, and the bushing assemblies 16A and 16B and 18A and 18B. Likewise, it includes the same aligned left and right pairs of throats, the front throats 86A and 88A and the rear throats 90A and 92A being illustrated. The alternate embodiment coupler apparatus 10' also includes the interior panels 68 and 70. The opening 74 in the upper panel 70 may be omitted, if desired. Similarly, the wedge block 132 having spaced-apart oblique surfaces 136 is utilized and disposed between the panels 68 and 70 for sliding translation.

The wedge block 132 is coupled by the use of any conventional fastener to a piston rod 210 which extends between the wedge block 132 and a single acting hydraulic or pneumatic cylinder 212. A compression spring 214 is disposed about the piston rod 210 and biases the wedge block 132 to the position illustrated in FIG. 7. A hydraulic or pneumatic hose 216 couples the interior of the hydraulic or pneumatic cylinder 212 with a source of controlled, pressurized air or hydraulic fluid (not illustrated). When air or hydraulic fluid under pressure is supplied through the hydraulic or pneumatic line 216 to the hydraulic or pneumatic cylinder 212, the piston rod 210 translates to the left as illustrated in FIG. 7, against the force of the compression spring 214, translating the wedge block 132 to the left such that the third pair of throats 90A and 90B and the fourth pair of throats 92A and 92B are open and permit entry or egress of a bucket crossbar such as the crossbar 40 associated with the bucket 30 illustrated in FIGS. 1 and 2. Upon the termination of hydraulic or pneumatic pressure, the wedge block 132 returns to the position illustrated in FIG. 7 under the force and influence of the compression spring 214. The compression spring 214 functions as a fail safe device to ensure that any attachment coupled by a crossbar member 40 within the throats 90A and 90B and 92A and 92B will remain so attached unless hydraulic or pneumatic pressure is specifically applied to permit release of such attachment. Thus, the maintenance of hydraulic or pneumatic pressure in the hydraulic or pneumatic cylinder 212 is not necessary to maintain an attachment within the coupling apparatus 10'.

The operation of the preferred embodiment coupling apparatus 10 and alternate embodiment coupling apparatus 10' will now be described. First with reference to the preferred embodiment coupling apparatus 10, it will be assumed that the operator of a crane or backhoe (both not illustrated) is desirous of engaging an attachment such as the bucket 30. Accordingly, the boom or dipper stick represented by the beams 20 and 22 and the coupling apparatus 10 are arranged relative to the bucket 30 such that the front crossbar 38 may be received within the front pair of throats 88A and 88B as illustrated in FIG. 1. During this initial linkup, it will be appreciated that the throats 86A and 86B having a slightly larger diameter assist in alignment of the throats 88A and 88B with the front crossbar 38 as previously noted.

Figure 2:
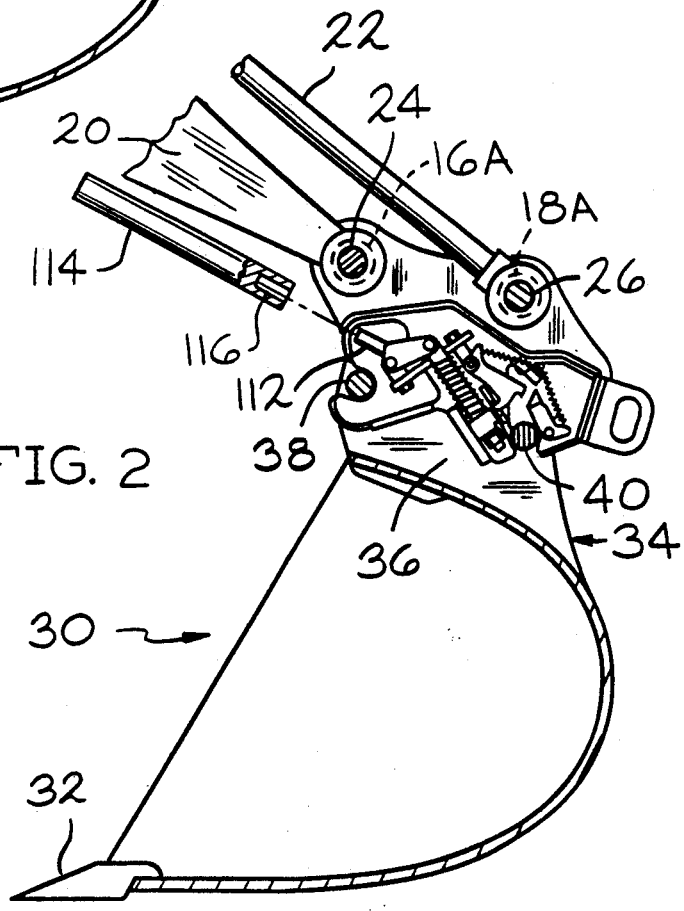
FIG. 2 is a full sectional view of a bucket and semi-automatic coupling apparatus according to the instant invention disposed upon a backhoe dipper stick with the coupling apparatus fully engaged to the bucket.

When the front crossbar 38 is fully seated within the throats 88A and 88B, the beam 22 is extended relative to the beam 20 such that the coupling apparatus 10 pivots about the axis of the front crossbar 38 in a clockwise direction and the coupling apparatus 10 moves to the position illustrated generally in FIG. 2.

At this time, the rear crossbar 40 contacts the body of the pawl assembly 174 driving it up and counterclockwise from the position illustrated in FIG. 1 to the position illustrated in FIGS. 2 and 4. Such motion of the pawl assembly 174 engages the secondary latch 162 of the latch member 156, moving it upwardly and in a counterclockwise direction about the pivot pin 154. This motion of the latch member 156 causes the primary latch 160 to move upwardly, off the obliquely disposed latch surface 138 of the wedge block 132 thereby releasing the wedge block 132. Under the influence of the compression spring 130, the wedge block 132 translates to the right and the oblique cam surfaces 136 both engage the rear crossbar 40 of the bucket 30 and drive it upwardly into intimate engagement with the fourth pair of throats 92A and 92B. At this time, the bucket 30 is coupled to the coupling apparatus 10 and thus to the backhoe or crane (not illustrated).

To release the bucket 30, the bucket 30 is positioned on the ground or other stable horizontal surface and the operator bar 114 (illustrated in FIG. 2) is seated upon the stub shaft 112. The operator bar 114 is manually moved downwardly in a counterclockwise direction about the pivot pin 104. Through the action of the clevis assembly 106, the wedge block 132, which is coupled to the clevis assembly 106 by the actuator rod 124, is translated upwardly, to the left in FIGS. 1 and 2 until the primary latch 160 of the latch member 156 re-engages the oblique latch surface 138 of the wedge block 132. At this time, the coupling assembly 10 may be rotated about the axis of the front crossbar 38 by manipulation of the crane or boom and specifically the beam 22. As the rear crossbar 40 exits the throats 92A and 92B, the pawl assembly 174, under the influence of the third tension spring 202 resets. In the reset position, the pawl 186 is below and disposed in operable engagement with the secondary latch 162 of the latch member 156. The coupling apparatus 10, which is now generally in the position illustrated in FIG. 1, may be completely disengaged from the bucket 30 by further rotation of the coupling apparatus 10 about the front crossbar 30 and lifting thereof or moving the coupling apparatus 10 up and to the right as illustrated in FIG. 1 by appropriate adjustment of the crane or boom. It will thus be appreciated that while linkup of the coupling apparatus 10 with a bucket 30 or other attachment is automatic, that is, accomplished without manual assistance, release of said bucket 30 or other attachment requires express, manual intervention. The apparatus is thus denominated semi-automatic.

With reference now to FIG. 7, it will be appreciated that the operation of the alternate embodiment coupler apparatus 10' is similarly straightforward. The alignment and engagement of the front crossbar 38 of a bucket 30 are performed in the identical manner. To engage the rear crossbar 40 of a bucket, pressurized fluid which may be either hydraulic fluid or air, as appropriate, is supplied to the cylinder 212 through the line 216 to retract the wedge block 132 against the force of the compression spring 214 such that the rear crossbar 40 may readily be received within the fourth pair of throats 92A and 92B. The coupling apparatus 10 is then rotated such that the rear crossbar 40 fully seats within the throats 92A and 92B and pressurized fluid is released from the cylinder 212. The compression spring 214 then returns the wedge block 132 to the position illustrated in FIG. 7. It will be appreciated that the compression spring 214 functions as a fail safe device to ensure that at all times when pressurized fluid is not applied to the cylinder 212, the wedge block 132 remains extended so that a bucket 30 or other attachment is positively retained within the alternate embodiment coupling apparatus 10'. To release the bucket 30, the above recited steps are undertaken in the reverse order.

The foregoing disclosure is the best mode devised by the inventor for practicing this invention. It is apparent, however, that devices incorporating modifications and variations will be obvious to one skilled in the art of mechanical couplers. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. A coupling apparatus comprising, in combination, first throat means for receiving a first crossbar of an attachment, second throat means for receiving a second crossbar of the attachment, wedge means disposed for linear translation between a first, open position in which said second crossbar may be translated into and out of said second throat means and a second, closed position in which said second crossbar is retained in said second throat means, said wedge means including a surface for engaging said second crossbar and seating said second crossbar in said second throat when said wedge means is in said second position, means for translating said wedge means toward said second position, latch means for maintaining said wedge means in said first position, pawl means disposed in said second throat means for translating said latch means when translated by said second crossbar to release said wedge means.

2. The coupling apparatus of claim 1 wherein said means for translating is a compression spring.

3. The coupling apparatus of claim 1 further including means for translating said wedge means to said first position.

4. The coupling apparatus of claim 3 wherein said means for translating said wedge means to said first position includes a lever having a pivot and a pair of arms, one of said arms operably coupled to said wedge means and other of said arms configured to receive energy for translating said wedge means to said first position.

5. The coupling apparatus of claim 1 further including spaced-apart pairs of bushings for securing said coupling apparatus to a boom or dipper stick.

6. The coupling apparatus of claim 1 further including a housing having a pair of spaced-apart sidewalls, said sidewalls defining said first and said second throat means.

7. The coupling apparatus of claim 1 wherein said first throat means is oriented at an angle of 90° to said second throat means.

8. The coupling apparatus of claim 1 further including means for adjusting said second position of said wedge means relative to said second throat means.

9. A coupling apparatus comprising, in combination, first throat means for engaging a first crossbar, second throat means for engaging a second crossbar parallel to and spaced from said first crossbar, wedge means disposed for linear translation between a first position in which said second crossbar may be translated into and out of said second throat means and a second position in which said second crossbar is retained in said second throat means, said wedge means including a surface for engaging said second crossbar and seating said second crossbar in said second throat when said wedge means is in said second position, means for translating said wedge means toward said first position, and compression spring means for biasing said wedge means toward said second position.

10. The coupling apparatus of claim 9 further including means for maintaining said wedge means in said first position and pawl means disposed for engagement by the second crossbar for translating said latch means to release said retaining means.

11. The coupling apparatus of claim 9 wherein said means for translating said wedge means to said first position includes a lever having a pivot and a pair of arms, one of said arms operably coupled to said wedge means and other of said arms configured to receive energy for translating said wedge means to said first position.

12. The coupling apparatus of claim 9 wherein said means for translating said wedge means is a piston disposed in a cylinder.

13. The coupling apparatus of claim 9 further including a housing having a pair of spaced-apart sidewalls, said sidewalls defining said first and said second throat means.

14. A coupler apparatus for disposition on a material handling device comprising, in combination, a pair of spaced apart wall members defining a first pair of throats for receiving a first crossbar of an attachment and a second pair of throats for receiving a second crossbar of the attachment, wedge means disposed for linear translation between a first, open position in which said second crossbar may be translated into and out of said second pair of throats and a second, closed position in which said second crossbar is retained in said second pair of throats, said wedge including an oblique surface for engaging said second crossbar and seating said second crossbar in said second throat when said wedge means is in said second position, spring means for biasing said wedge means toward said second position, latch means for maintaining said wedge means in said first position, pawl means disposed between said second pair of throats and in operable relationship with said latch means for translating said latch means when translated by said second crossbar to release said wedge means from said first position.

15. The coupler apparatus of claim 14 wherein said spring means for biasing is a compression spring.

16. The coupler apparatus of claim 14 further including means for translating said wedge means to said first position.

17. The coupler apparatus of claim 16 wherein said means for translating said wedge means includes a lever having a pivot and a pair of arms, one of said arms operably coupled to said wedge means and other of said arms configured to receive energy for translating said wedge means to said first position.

18. The coupler apparatus of claim 14 wherein said first pair of throats are oriented at substantially a right angle to said second pair of throats.

19. The coupler apparatus of claim 14 wherein said first pair of throats are disposed at an angle of 90° to said second pair of throats.

20. The coupler apparatus of claim 14 further including spring means for biasing said latch means and said pawl means.

* * * * *